United States Patent [19]

Bradley

[11] Patent Number: 4,679,607

[45] Date of Patent: Jul. 14, 1987

[54] LOG SPLITTER

[76] Inventor: Terry Bradley, Box 12, Howell, Utah 84316

[21] Appl. No.: 848,743

[22] Filed: Apr. 4, 1986

[51] Int. Cl.[4] ..... B27L 7/00

[52] U.S. Cl. ..... 144/193 A; 144/193 E; 144/366

[58] Field of Search ..... 144/3 K, 193 R, 193 A, 144/366, 193 D, 193 E

[56] References Cited

U.S. PATENT DOCUMENTS

| | | | |
|---|---|---|---|
| 3,319,675 | 5/1967 | Bles, Sr. | 144/193 |
| 3,974,867 | 8/1976 | Butas, Jr. | 144/193 A |
| 4,033,390 | 7/1977 | Piontkowski | 144/193 D |
| 4,192,364 | 3/1980 | Findley | 144/193 A |
| 4,194,544 | 3/1980 | Scott et al. | 144/193 |
| 4,239,070 | 12/1980 | Burns | 144/193 A |
| 4,310,039 | 1/1982 | O'Brien | 144/193 A |
| 4,327,787 | 3/1982 | Loratto | 144/193 |
| 4,366,848 | 1/1983 | Gavinski | 144/193 A |
| 4,411,298 | 10/1983 | Ellingsen et al. | 144/193 A |
| 4,416,313 | 11/1983 | Seeger | 144/193 R |
| 4,428,409 | 1/1984 | Roetzler | 144/193 A |
| 4,470,441 | 9/1984 | Wirsbinski et al. | 144/193 A |
| 4,596,279 | 6/1986 | Taylor | 144/193 E |

*Primary Examiner*—W. D. Bray

*Attorney, Agent, or Firm*—Workman, Nydegger & Jensen

[57] ABSTRACT

A mechanical log splitter in which relative motion is imparted between a cleaving blade and a log longitudinal the axis thereof and the log is split by the cleaving blade being forced thereinto. All moving parts of the log splitter disclosed, except for a log-impelling block that forces each log onto the cleaving blade, are enclosed for safety reasons within an elongated support frame which is preferable made of metal pipe. Riding within the support frame, supporting the log-impelling block and releasably secured thereto to facilitate maintenance, is an elongated carriage, which may also be cylindrical. An activating means housed within support frame at one end of the cylinder drives the carriage and log-impelling block to splitting logs against the cleaving blade of the device. The cleaving blade comprises an elongated tapered body portion of either conical or pyramidal shape having the apex thereof directed toward the approaching log and a longitudinal axis parallel to the motion thereof. The body portion is attached to a planar footing having a knife-like edge also oriented toward the oncoming log and defining a plane containing longitudinal axis of the body portion. The cleaving blade design facilitates splitting of each log along its own self-defined line of least resistance.

43 Claims, 5 Drawing Figures

LOG SPLITTER

BACKGROUND OF THE INVENTION

1. The Field of the Invention

This invention relates to mechanical log splitters. More particularly, this invention relates to mechanical log splitters in which relative motion is imparted between a cleaving blade and a log longitudinal the axis thereof such that the log is split by the cleaving blade being forced thereinto.

2. The Background Art

Mechanical log splitters are known in which a log is split when a cleaving blade is forced into the log parallel to the longitudinal axis thereof because of relative motion imparted between the log and the cleaving blade by the log splitter. This relative motion may be created by either restraining the log to be split and mechanically driving the cleaving blade, or by forcing each log against and onto a cleaving blade that is fixed.

In either instance, however, a number of disadvantages afflict the known devices. Conventional cleaving blades take the form of upstanding plate-like knives or wedges. Many are by design extremely tall, so as to be at least equal to the diameter of the average log to be split. When such cleaving blades initially enter one end of a log, they impale it, thereby precluding rotation, and then proceed to sever the log along its length on a plane defined by the line of entry of the cleaving blade.

Unfortunately, this type of cleaving blade, no matter how sharply honed, fails to exploit the natural tendency of any given log to split along a line of least resistance, as when there are natural fracture lines in the log. Instead, such cleaving blades sever logs in a straight line without regard to tough spots, such as knots or burls, in a process which is more akin to cutting, than to splitting.

It has been observed that with the use of such conventional cleaving blades, the actual splitting of a log occurs within the early stages of initial penetration of the cleaving blade. Such splitting is often accompanied by a loud popping sound in the log within, for example, the first half inch of cleaving blade penetration. The remainder of the travel stroke of the log-splitting machinery involved merely spreads apart the already broken log, so that the power demand of the equipment is very uneven.

Nevertheless, it is frequently the case that the internal structure of the tough spots of a log in combination with its orientation on a mechanical splitter relative the plane of the cleaving blade do not lend themselves to such an initial split or break. Under these conditions, the log splitter must either drive the cleaving blade through the entire length of the log in a power-intensive slicing process, or become jammed. Once the log and cleaving blade are in contact, the plane upon which the two halves of the log will be separated is fixed. If this does not fortunitiously happen to closely coincide with a line of least resistance for splitting, a waste of energy and possibly jamming will result.

Furthermore, known devices using upstanding planar cleaving blades separate a log into two pieces of generally semicircular cross-section. Such pieces of wood are appropriate for use as firewood only if logs of relatively small diameter are used. Accordingly, the routine practice is to split in half each of these two pieces. This results in a log spit into quarters, but requires three strokes of the log splitter to do so.

Prior art mechanical log splitters frequently must have numerous exposed moving parts in addition to those components of the machine which actually effect the relative motion between a log and the cleaving blade. Such parts expose an operator, whose attention will naturally be focused upon the interaction of the cleaving blade and the log, to a great deal of danger. This is true even in the case where such additional moving parts are exposed only during a portion of the path of travel of the machinery of the device. Complex shrouds have been used to enclose such moving parts, but these needlessly increase the overall size and weight of the device. This is particularly true when the moving parts requiring enclosure would otherwise be exposed only during the extremes of their lines of travel.

Due to the great pressures required in mechanical log splitters, severe wear on contacting faces of moving parts is quite common. This in turn necessitates substantial down time for repairs. Many known mechanical log splitters only exacerbate this difficulty by failing to provide for ready disassembly of the machinery involved to replace parts most likely to fail.

Many mechanical log splitter designs have attempted to compensate for the problems of excessive jamming by employing extremely powerful activation means. The additional power provided is really useful only during initial cleaving blade penetration and is not utilized during the rest of the travel of the moving parts. Additional power, however, greatly increases the problem of wear. Rollers or bearings have been employed to counteract wear, but these dramatically increase the cost of manufacturing a piece of machinery which would otherwise be relatively inexpensive.

BRIEF SUMMARY AND OBJECTS OF THE INVENTION

In accordance with the present invention, a log splitter comprises a support frame housing a elongated enclosure, one or more cleaving means for splitting logs mounted on the exterior of the support frame, and a carriage slideably mounted within the elongated enclosure for reciprocating motion substantially therewithin.

In a preferred embodiment of the present invention, both the support frame and the carriage are cylindrical shells fabricated from heavy pipe, such that the outer surface of the carriage substantially conforms to the inner surface of the support frame. This dramatically increases the strength of the log splitter while substantially simplifying its fabrication. Without otherwise adding to the dimensions of the log splitter of the present invention, the support frame can enclose both the activating means and the carriage during all required motion thereof. This greatly enhances the safety of the device.

A log-impelling block on the exterior of the support frame is releasably secured to the carriage and moveable therewith between a loading position remote from one of the cleaving means and a cleaving position before the cleaving means. In the loading position a log for processing is received between the log-impelling block and the cleaving means. A log which is received between the log-impelling block and the cleaving means is split by being forced against and onto the cleaving means.

An activating means, such as a hydraulic cylinder, is mounted in the enclosure at one end of the carriage and operably connected thereto for propelling the carriage and driving the log-impelling block from the loading position to the cleaving position. Only the log-impelling block, among all of the moving parts of the device, need be accessible during operation. This greatly minimizes the risks to an operator.

In another aspect of the present invention, the cleaving means comprises an elongated tapered body portion having a vertex opposing the log-impelling block and a longitudinal axis parallel the line of motion thereof. The body portion may be shaped as a cone or a pyramid with the apex of either opposing the log-impelling block.

Attached to the body portion is a generally planar footing having a tapered, knife-like edge also opposing the log-impelling block. The footing defines a plane normal to the exterior of the support frame between the loading and cleaving positions. This plane contains all points on the longitudinal axis of the body portion. The knife-like edge of the footing is preferably at an acute angle to the longitudinal axis of the body portion in a direction away from the log-impelling block.

Thus, as a log is forced onto a cleaving means of the present invention, the gently tapered body portion effects an initial penetration without the application of undue amounts of power. During such stages of initial penetration, to a certain extent the log is able to define its own line of least resistance to the entering cleaving means. As a result, according to the structure of the log itself, a plane of splitting naturally develops radially outward through the log from the entering body of the cleaving means.

As the log continues to be forced onto the cleaving means, wider portions of the body portion enter the log, and cleavage along this natural splitting plane progresses. Thus, the cleaving means of the present invention not only substantially reduces the effective power required to split a log, but it also eliminates to a major degree the problem of jamming commonly observed in prior art devices.

It has been advantageously found that the cleaving means of the present invention need not have an extremely high profile, as do many of the planar cleaving blades known in the art. The lower profile of the present invention reduces the resistance to entry of the cleaving blade into a log. When embodied according to the teachings of the present invention, the cleavage blade described will split apart logs having a diameter several times the height of the cleaving blade.

Further, the cleaving blade of the present invention does not generally split a log into two semicircular pieces; instead, it splits the log into a smaller piece constituting about one-third of the log and a larger piece consisting of the remainder. The smaller piece, not being semicircular in cross-section, is suitable for use as firewood without further splitting. Using a second stroke of the log splitter of the present invention, the large piece of the log has been found to generally separate into two portions, each of which also comprises about one-third of the original log and each of which is appropriate for use as firewood. Thus, in contrast to the operation of log splitters generally known in the art, only two strokes, rather than three, are required to render most logs completely usable as firewood.

In another aspect of the present invention, means are provided for operably interconnecting the carriage, the log-impelling block, and the activating means, and for permitting the selective disassembly thereof. As provided in one embodiment, a primary coupling aperture is formed in the carriage of the invention. A coupling tongue depending from the log-impelling block is inserted through the primary coupling aperture. On the opposite side of the primary coupling aperture the coupling tongue is releasably secured to a clevis attached to the activating means.

Formed in the carriage laterally opposite the primary coupling aperture is a supplemental coupling aperture which receives the tip of the coupling tongue. The supplemental coupling aperture together with the primary aperture precludes translation or rotation of the log-impelling block in relation to the carriage during operation of the log splitter. This easy disassembly of these elements of the present invention facilitates maintenance, servicing, and the replacement of worn parts.

In yet another aspect of the present invention, the carriage of the present invention includes at least two bearing surfaces that ride against the inner surface of the support frame during the motion of the carriage therewithin. The bearing surfaces are spatially separated in a direction parallel to the motion of the carriage. The bearing surfaces also may substantially encircle the carriage. Optimally the distance between the bearing surfaces is greater than or equal to three times the lateral dimension of the elongated enclosure in the support frame housing the carriage. Such dimensioning of the carriage of the present invention gives great stability to the carriage and the log-impelling block it carries, thereby virtually eliminating the possibility for these components to become twisted out of their designed alignment. This configuration also reduces component destruction and the waste of energy represented by wear.

The principle of the present invention can be applied to a double-action log splitter by mounting first and second cleaving means as described above at fixed positions in a confronting relationship on the support frame. In such a configuration, the log-impelling block moves between the two cleaving blades under the action of a two-way activating means enclosed by, and secured to, the support frame.

Thus, among the objects of the present invention is that of a mechanical log splitter which is less susceptible to jamming than known log splitters that employ knife-like cleaving means. Another object is to permit reduction of a given log to usable firewood through fewer strokes of the log splitter. It is yet another object of the present invention to reduce component wear in a mechanical log splitter, thereby saving maintenance time and lowering the power demand placed on the activating means of the device. For safety purposes, yet another object of the present invention is to reduce the number of exposed moving parts in a mechanical log splitter. Finally, it is an object of the present invention that a mechanical log splitter as described above be extremely sturdy, inexpensive to manufacture, and easily disassemble. This object is achieved through use of the elegantly simplified design for a log splitter disclosed hereafter.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The invention will be described with additional specificity and detail through the use of the accompany drawings in which.

DESCRIPTION OF THE PREFERRED EMBODIMENT

Figure 1:
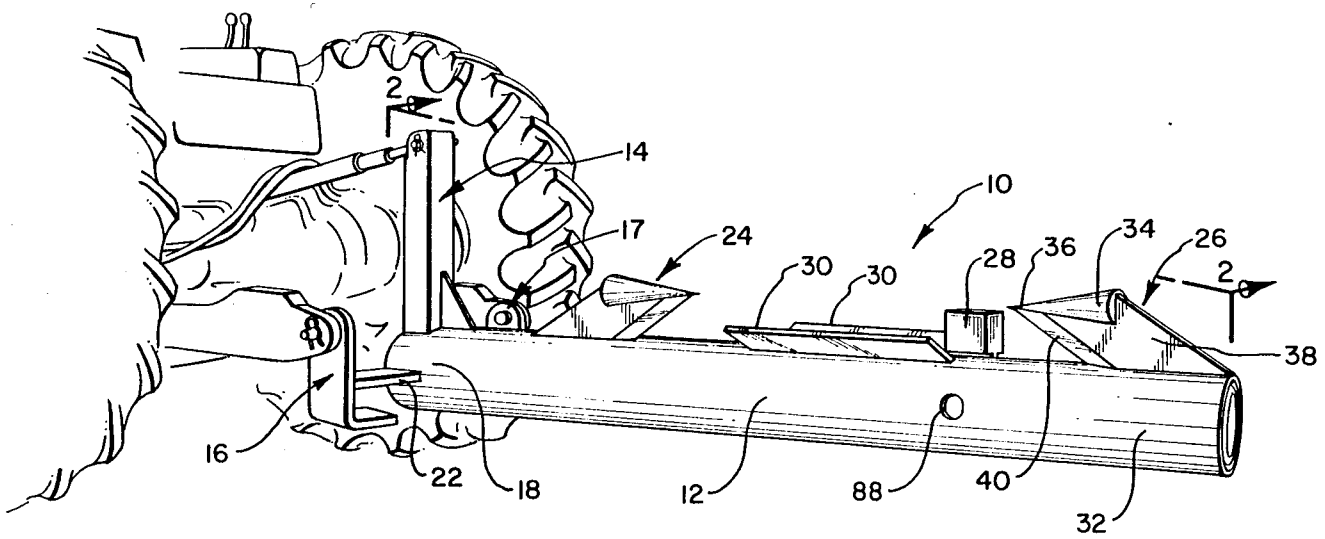
FIG. 1 is a perspective view of a log splitter incorporating the teachings of the present invention and attached for operation to the rear of a tractor.

The external aspects of a double-action log splitter embodied according to the present invention will be illustrated by reference to FIG. 1. There, log splitter 10 includes an elongated cylindrical support frame 12 provided with a hitching means for attaching log splitter 10 to a vehicle. By way of example, in the embodiment shown in FIG. 1, such a hitching means comprises upright member 14 and horizontal connectors 16 and 17 at either side thereof. Upright member 14 and horizontal connectors 16 and 17 are attached at end 18 of support frame 12 and together form a three-point tractor hitch for selectively attaching log splitter 10 to tractor 20 by known means. Horizontal connectors 16 and 17 are secured at the outer ends of a horizontal beam 22 which passes through and is welded to end 18 of support frame 12. Horizontal beam 22 interacts with additional components of log splitter 10 housed within support frame 12, as will be described subsequently.

In accordance with one aspect of the present invention, a double-action log splitter, such as log splitter 10, is provided with a pair of cleaving means for splitting logs to be processed by the log splitter. Nevertheless, such a device employing only one cleaving means is still within the scope of the present invention. By way of example and not limitation, cleaving blades 24 and 26 are mounted at fixed positions on the exterior of support frame 12 in a confronting relationship one with each other. Intermediate cleaving blades 24 and 26 is a log-impelling block 28 which is moveable therebetween in a manner to be described subsequently.

On either side of the line of motion of log-impelling block 28 on the exterior of support frame 12 are log support flanges 30. Log support flanges 30 serve to hold in place a log received for processing between log-impelling block 28 and either of cleaving blades 24 or 26. In FIG. 1, log-impelling block 28 is shown at one extreme of its line of motion adjacent cleaving blade 26. Accordingly, a log for processing on the next stroke of log splitter 10 would be placed on support frame 12 between log-impelling block 28 and cleaving blade 24.

Cleaving blades 24 and 26 are substantially identical. Accordingly, only the structure of cleaving blade 26 located at end 32 of support frame 12 opposite from the three-point tractor hitch will be described in detail. Cleaving blade 26 comprises an elongated tapered body portion 34 having a longitudinal axis parallel to the line of motion of log-impelling block 28. Body portion 34 terminates at one end thereof in a vertex 36 which is directed toward cleaving blade 24. Thus, vertex 36 also opposes log-impelling block 28.

Supporting and attached to body portion 34 is a generally planar footing 38 which has a tapered, knife-like edge 40 also oriented toward cleaving blade 24 and log-impelling block 28. Footing 38 defines a plane which contains all points on the longitudinal axis of body portion 34 and is perpendicular to the portion of the surface of support frame 12 between cleaving blades 24 and 26.

In the preferred form of a cleaving blade shown in FIG. 1, body portion 34 thereof is a cone. The apex of the cone opposes the log-impelling block of the log splitter with which it is used. In a double-action log splitter, the apex of a thusly-configured cone-shaped body portion of a cleaving blade would be oriented toward the other cleaving blade of the log splitter. Other configurations of the body portion of a cleaving blade according to the present invention are possible and disclosed later in this specification.

Preferably, knife-like edge 40 of footing 38 is at an acute angle to the longitudinal axis of body portion 34 in a direction away from log-impelling block 28 and cleaving balde 24. Thus, a line defined by knife-like edge 40 of footing 38 forms an acute angle with the half of the longitudinal axis of body portion 34 extending therethrough from vertex 36. Footing 38 and body portion 34 may optionally be welded together or integrally formed.

The structure just described for cleaving blade 26 is illustrative of the broad teaching of this aspect of the present invention. In other embodiments of a cleaving blade according to such teachings, only such variations in structure that depart from that of cleaving blade 26 will be mentioned.

Due to the unique capability of the cleaving blade of the present invention to split logs with ease, it is recommended that the height of such a cleaving blade from the bottom of its footing to the vertex of its body portion be no more than half the diameter of the typical log to be split by the device. The cleaving blade can be reduced in height even to one third or one quarter of the diameter of a typical log to be processed by the apparatus. A cleaving blade employed quite successfully by the inventor of the log splitter disclosed herein has a height of but four inches.

Figure 2:
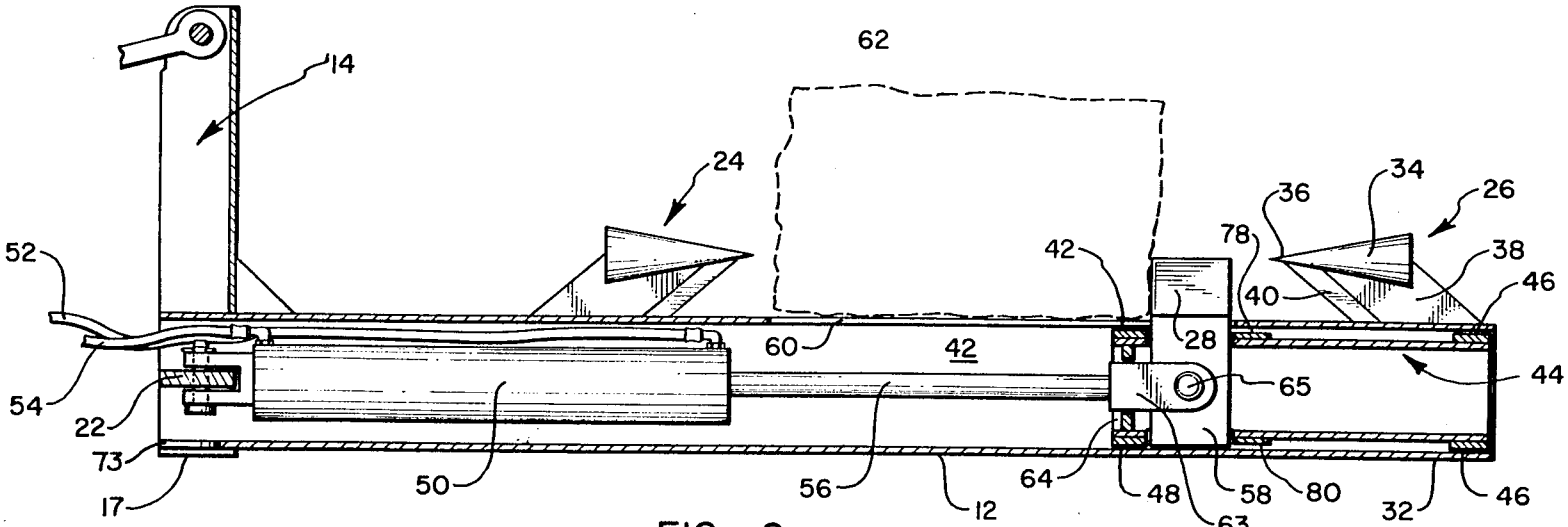
FIG. 2 is a longitudinal cross-section of a log splitter according to the present invention taken along section lines 2—2 in FIG. 1.

Referring now to FIG. 2, which is cross-section showing the internal parts of log splitter 10, it can be seen that support frame 12 is a cylindrical shell housing an elongated enclosure 42. Elongated enclosure 42 contains all moving parts of log splitter 10, except for log-impelling block 28. One such moving part is a carriage 44 which is also shown to be a cylindrical shell. In the broad aspects of the present invention, the outer cross-section of carriage 44 substantially conforms to the inner cross-section of support frame 12 and elongated enclosure 42 therewithin. Support frame 12 and carriage 44 may advantageously be fabricated from steel pipe thereby affording great economies in manufacture and sturdy construction.

Carriage 44 upholds log-impelling block 28 and is slideably mounted for reciprocating motion substantially within support frame 12. Thus, movement of carriage 44 offers no danger to an operator of log splitter 10, as carriage 44 reaches the extreme of its line of motion before reaching end 32 of support frame 12 which is open to permit assembly and disassembly of the log splitter.

In the embodiment of the present invention illustrated in FIGS. 1 and 2, support frame 12 and carriage 44 are depicted as cylindrical shells. The broad concept of the present invention is nevertheless such that a support frame housing an elongated enclosure of any cross-section when used in combination with a carriage of corresponding cross-section is considered to be within the scope of the present invention. A support frame of seven feet in length in combination with a two-foot long carriage is suitable for a double-action, or two-way log splitter as shown in FIGS. 1 and 2.

In the reciprocating motion of carriage 44 within support frame 12, the outer surface of carriage 44 can bear directly against the inner surface of support frame 12. In the alternative, as depicted in FIG. 2, the outer cross-section of carriage 44 may be slightly smaller than the inner cross-section of support frame 12, provided that carriage 44 includes at least two bearing surfaces 46 and 48 that ride against the inner surface of support frame 12.

Bearing surfaces 46 and 48 are spatially separated from each other in a direction parallel the motion of carriage 44. The use of two bearing surfaces insures maximum stability to carriage 44 and prevents uneven wear and the need for additional activating force to counteract twisting of carriage 44 within enclosure 42. It has been found that the distance between bearing surfaces 46 and 48 should preferably be greater than or equal to the lateral dimension of elongated enclosure 42. More preferably the distance between bearing surfaces 46 and 48 should be greater than or equal to twice, or even three times, the lateral dimension of elongated enclosure 42.

Also secured within the support frame of a log splitter according to the present invention is a two-way activating means for driving a carriage, such as carriage 44, and log-impelling block in reciprocating motion. As seen in FIG. 2, a two-way activating means in the form of a hydraulic cylinder 50 is secured within elongated enclosure 42 to horizontal beam 22 at end 18 of carriage 44.

Hydraulic cylinder 50 is powered by pneumatic lines 52 and 54 which are connected to a suitable source of pneumatic power, such as the power-take-off of tractor 14. Pneumatic lines 52 and 54 should access hydraulic cylinder 50 on the upper surface thereof in order to avoid fouling by debris which may fall into and settle at the bottom of enclosure 42. Hydraulic cylinder 50 drives a ram shaft 56 which is operably connected to carriage 44 in a manner yet to be described.

Block 28 is supported by carriage 44 on a coupling tongue 58 which passes through and travels within an elongated slot 60 formed in the support frame 12 between cleaving blades 24 and 26. In operation, hydraulic cylinder 50 propels carriage 44 in reciprocating motion within support frame 12 and thus drives log-impelling block 28 between a loading position remote from one of the cleaving blades and a cleaving position adjacent thereto. In this manner, a log for processing, such as log 62 as shown in FIG. 2, which is received between log-impelling block 28 and one of the cleaving blades, is thereafter split by being forced against and onto that cleaving blade. In the process, however, all moving parts except for log-impelling block 28 are enclosed by support frame 12. The relationship among components of double-action log splitter 10 are such that split portions of logs being processed are automatically pushed out of the area between log-impelling block 28 and the other cleaving blade, thereby permitting the next log for processing to be immediately loaded and driven against the other cleaving blade on the return stroke of hydraulic cylinder 50.

In another aspect of the present invention, a mechanical log splitter as described above is provided with coupling means for operably interconnecting a carriage, such as carriage 44, a log-impelling block, such as log-impelling block 28, and a two-way activating means, such as hydraulic cylinder 50. The coupling means contemplated also permits selective disassembly of these components of the log splitter to enable their repair, maintenance, or replacement as needed.

Figure 3A:
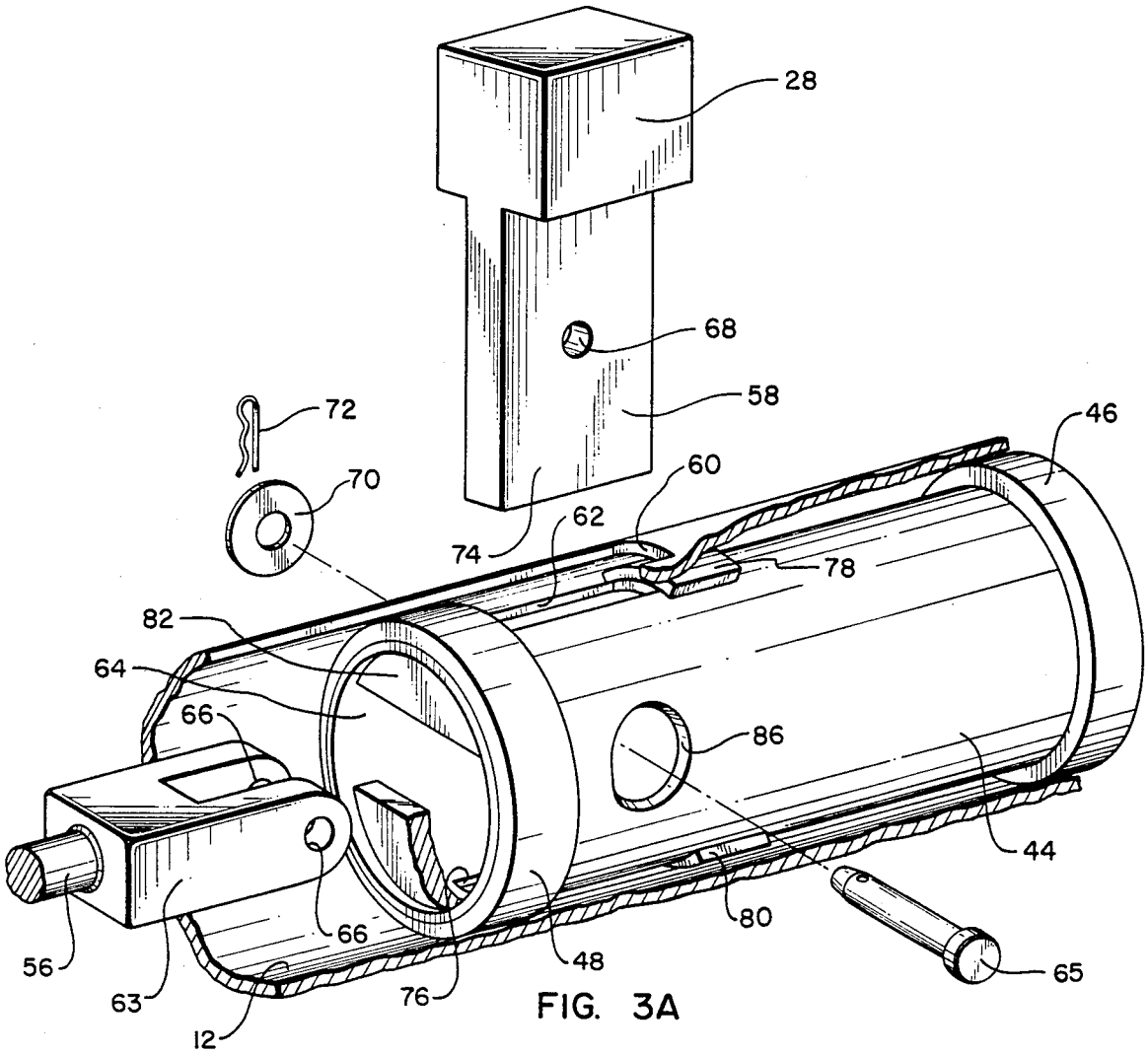
FIG. 3A is a detailed exploded perspective cross-sectional view of the interconnection of elements of the log splitter shown in FIGS. 1 and 2.

As shown in disassembled detail in FIG. 3A, a primary coupling aperture 62 is formed in carriage 44 opposite elongated slot 60 in support frame 12. Coupling tongue 58 depending from log-impelling block 28 is inserted through primary coupling aperture 62. A clevis 63 attached to ram shaft 56 is inserted through the end 64 of carriage 44 adjacent hydraulic cylinder 50 to meet and be releasably secured to coupling tongue 58.

Figure 3B:
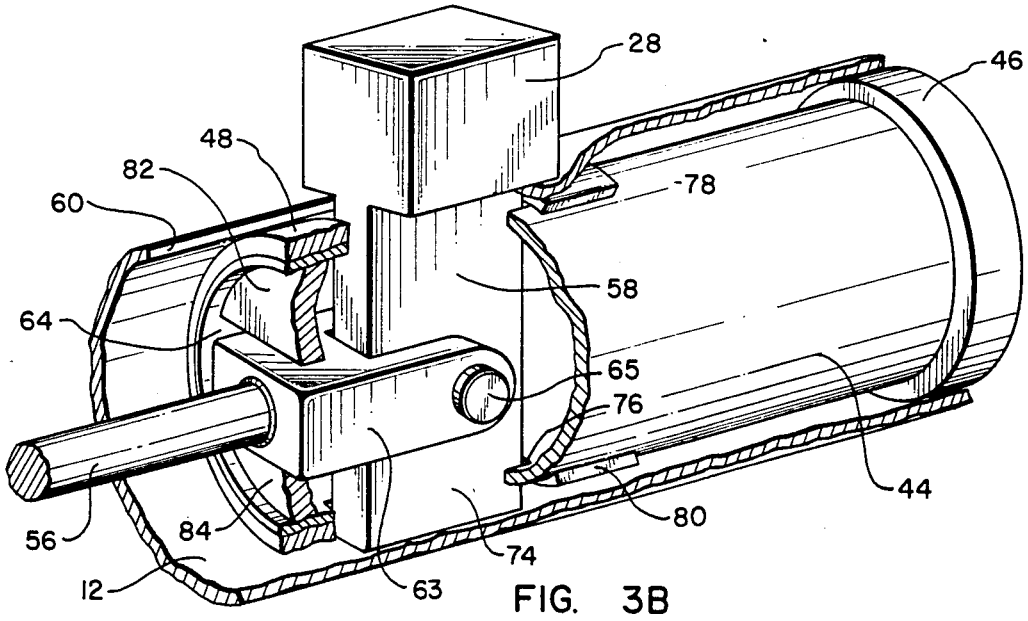
FIG. 3B is an assembled cross-sectional perspective cross-sectional view of the components of the log splitter shown in FIG. 3A.

A releasable interconnection can be effected, for example, by a pin 65 inserted through eyes 66 in the legs of clevis 63 and aperture 68 in coupling tongue 58, in the manner shown in FIG. 3B. Pin 65 can be retained in position by conventional means such as by a washer 70 and a spring clip 72 applied to the end of pin 64 remote from the head thereof. A similar method of attachment may be used to secure hydraulic cylinder 50 to horizontal beam 22 above a cutout 73 in end 18 of support frame 12, as seen in FIG. 2.

Coupling tongue 58 may be reinforced by its elongation in a plane aligned with the line of motion of log-impelling block 28. Schedule 40 steel pipe has been used to fabricate carriage 44 and support frame 12. When the inside diameters of carriage 44 and frame 12 are six inches and eight-inches respectively, a one inch thick coupling tongue had to be made a least four inches wide to avoid distortion of coupling tongue 58 in the vicinity of aperture 68.

Carriage 44 includes means for receiving the tip 74 of coupling tongue 58 on the opposite side of clevis 63 from primary coupling aperture 62 when clevis 63 is releasably secured to coupling tongue 58. As best seen in FIG. 3B, tip 74 of coupling tongue 58 is received in a supplemental coupling aperture 76 formed in carriage 44 laterally opposite primary coupling aperture 62.

The cross-section of primary coupling aperture 62 and supplemental coupling aperture 76 conforms substantially to the cross-section of the portions of coupling tongue 58 correspondingly received therein when coupling tongue 58 is releasably secured to clevis 63. This fit between coupling tongue 58 and carriage 44 precludes translation or rotation of log-impelling block 28 in relation to carriage 44 during operation of the log splitter. Any tendency of log-impelling block 28 to rotate during operation of the log splitter is thus transferred to bearing surfaces 46 and 48. In FIGS. 3A and 3B, bearing surfaces 46 and 48 can be seen to encircle carriage 44 substantially conforming to the cross-section of elongated enclosure 42 within support frame 12.

Both primary coupling aperture 62 and supplemental coupling aperture 76 are preferably formed in carriage 44 abutting bearing surface 48 at the end of carriage 44 adjacent hydraulic cylinder 50. Bearing surface 48 accordingly adds strength to the ends of primary coupling aperture 62 and supplemental coupling aperture 76 to which bearing surface 48 is adjacent. Similar reinforcement to restrain any twisting of log-impelling block 28 can be added to the opposite ends of primary coupling aperture 62 and supplemental coupling aperture 76 by a coupling aperture tongue abutment 78 at the opposite end of primary coupling aperture 62 and by a coupling tongue abutment 80 at the opposite end of supplemental coupling aperture 76.

The inner surface of the end 64 of carriage 44 is provided with an upper shoulder 82. Upper shoulder 82 bears against the upper surface of clevis 63 in order to prevent upward movement of log-impelling block 28 when clevis 63 is releasably secured thereto. Optionally, a lower shoulder 84 may be welded inside carriage 44 laterally opposite upper shoulder 82. As best seen FIG. 3B, lower shoulder 84 bears against the lower surface of clevis 63 and resists downward thrust upon log-impelling block 28 when releasably secured to clevis 63.

In order to enable assembly and disassembly of log-impelling block 28, clevis 63, and carriage 44, access is afforded through both carriage 44 and support frame 12 for manipulating interconnecting pieces, such as pin 65, washer 70, and spring clip 72. Such access can take the form of windows 86 (as shown in FIG. 3A) formed on one or both sides of carriage 44 in combination with openings, such as windows 88 formed in one or both sides of support frame 12 (as shown in FIG. 1).

Once pin 65 is removed, log-impelling block 28 may be withdrawn upwardly out of supplementary coupling aperture 76 and primary coupling aperture 62 and through elongated slot 60 in support frame 12. Then if desired, carriage 44 may be slid laterally through open end 32 of support frame 12. Hydraulic cylinder 50 may be removed from within support frame 12 through open end 32 thereof after detaching it from horizontal beam 22 and uncoupling pneumatic lines 52 and 54 from the source of pressure to hydraulic cylinder 50.

Figure 4:
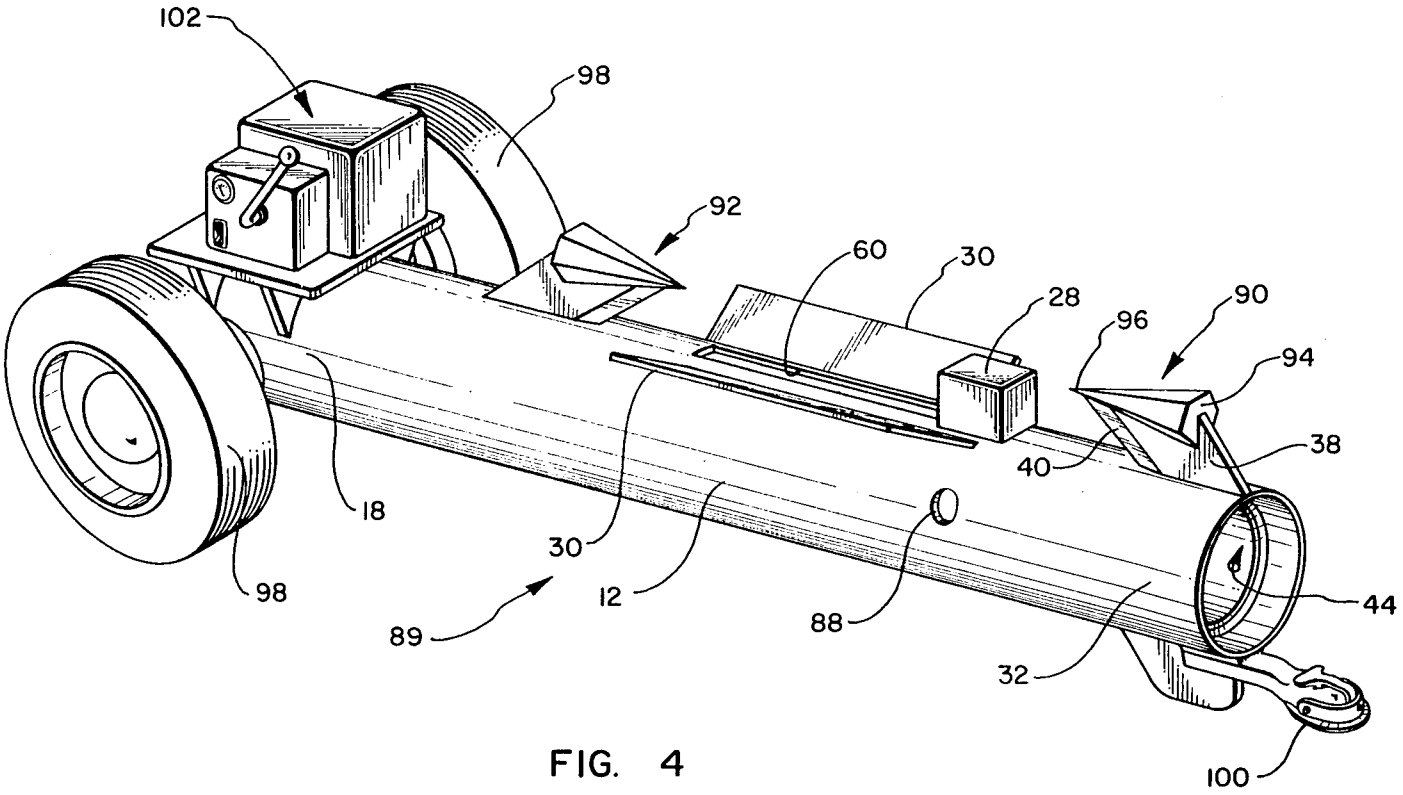
FIG. 4 is a perspective view of an alternative embodiment of a log splitter according to the present invention.

External aspects of an alternative embodiment of a log splitter 89 according to the present invention can be seen in FIG. 4. A support frame 12, consisting of a hollow cylindrical shell, houses a slideably mounted carriage 44. Carriage 44 supports a log-impelling block 28 for movement in a elongated slot 60 formed in the upper surface of support frame 12. Access to the coupling of log-impelling block 28 and carriage 44 is obtainable through window 88 formed in the side of support frame 12 and through open end 32 thereof. Mounted on the outside of support frame 12 at opposite ends of elongated slots 60 is an alternative embodiment of a cleaving means according to the teachings of the present invention.

Cleaving blades 90 and 92 are substantially identical; accordingly, only the structure of cleaving blade 90 will be discussed in detail. Cleaving blade 90 has an elongated body portion 94 that is is pyramidal in shape and has the apex 96 thereof oriented toward cleaving blade 92 and log-impelling block 28. While body portion 94 of cleaving blade 90 is shown as having five triangular faces, a pyramidal shaped body portion of a cleaving blade according to the present invention could have any number of pyramidal faces and yet remain within the scope of the teachings of this invention.

Planar footing 38 for cleaving blade 90 with tapered knife-like edge 40 oriented toward log-impelling block 28 and cleaving blade 92 is of the same type as used with cleaving blade 26 in FIG. 1. Nevertheless, for best results, when the body portion of a cleaving blade according to the present invention is pyramidal in form, footing 38 should be joined thereto at the intersection of two of the triangular faces of the pyramidal shape. This has the result of diverting fractured pieces of a log outwardly from footing 38 and the surface of support frame 12, preventing such pieces from wedging between body portion 94 and the top surface of support frame 12.

Log splitter 89 includes support wheels 98 and a towing attachment 100 which together permit log splitter 89 to be drawn behind a truck or other vehicle. Additionally, log splitter 89 carries its own source of power 102 for driving the actuating mechanism housed within supporting frame 12.

As compared to log splitters known in the art, the mechanical log splitter as described above requires less power to penetrate and split logs. In contrast to conventional upstanding plate-like knives or wedges used as cleaving blades, the cleaving blade employed in the present invention penetrates each log very gradually and permits the log to split along its weakest line of fracture. In addition, the splitting that results generally permits a single log to be rendered useful for firewood in only two strokes of the device. The increased ease of cleavage permits the use of smaller activating means to produce an equivalent effect as with cleaving blades known in the art.

The design of the log splitter of the present invention keeps all moving parts, except for the log-impelling block, out of contact with an operator, increasing safety. Use of metal pipes of appropriate diameter for the support frame and the carriage moveably mounted therein permits dramatic economies in manufacture and produces extremely durable equipment. Easy disassembly of parts of the log splitter which bear upon one another and upon logs being processed, permit such parts to be repaired or replaced with ease. Nevertheless, due to the sturdy manner of interconnecting such parts and the ability to operate with lower power, wear or damage thereto is less common than in known devices.

The invention herein claimed may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A double-action log splitter, comprising:

a support frame;

first and second cleaving means for splitting logs, said cleaving means being mounted at fixed positions in a confronting relationship on the exterior of the support frame;

a log-impelling block movable therewith between the first and second cleaving means;

a carriage enclosed within the support frame upholding the log-impelling block and slideably mounted for reciprocating motion substantially within the support frame, the outside cross-section of the carriage being generally cylindrical and substantially conforming to the inside cross-section of the support frame; and two-way activating means mounted within the support frame at one end of the carriage for driving the carriage and log-impelling block alternately toward the first and the second cleaving means.

2. A double-action log splitter as recited in claim 1, wherein the two-way activating means is a hydraulic cylinder.

3. A double-action log splitter as recited in claim 1, wherein the support frame is a generally cylindrical shell.

4. A double-action log splitter as recited in claim 3, wherein the dimension of the carriage longitudinal the support frame is greater than or equal to the dimension of the carriage transverse the support frame.

5. A double-action log splitter as recited in claim 4, wherein the dimension of the carriage longitudinal the support frame is greater than or equal to twice the dimension of the carriage transverse the support frame.

6. A double-action log splitter as recited in claim 5, wherein the dimension of the carriage longitudinal the support frame is greater than or equal to three times the dimension of the carriage transverse of the support frame.

7. A double-action log splitter as recited in claim 1, wherein the support frame between the first and second cleaving means is formed into an elongated slot through which the log-impelling block is mounted to the carriage for motion between the first and second cleaving means.

8. A double action log splitter as recited in claim 7, wherein a log support flange is attached to the exterior of the support frame on either side of the elongated slot.

9. A double-action log splitter as recited in claim 1, wherein said first and second cleaving means each comprise:

an elongated tapered body portion having a vertex opposing the log-impelling block and a longitudinal axis parallel the line of motion of the log-impelling block; and a generally planar footing having a tapered, knife-like edge opposing the log-impelling block, said footing being attached to the body portion and defining a plane containing all points on the longitudinal axis thereof.

10. A double-action log splitter as recited in claim 9, wherein the plane defined by the footing of each of the cleaving blades is perpendicular to the portion of the surface of the support frame between the first and second cleaving blades.

11. A double-action log splitter as recited in claim 9, wherein the body portion and the footing of each of the cleaving blades are integrally formed.

12. A double-action log splitter as recited in claim 9, wherein the body portion of each of the cleaving means is a cone, and the apex of said cone opposes the log-impelling block.

13. A double-action log splitter as recited in claim 9, wherein the body portion of each of the cleaving means is of pyramidal shape, the apex of said pyramidal shape opposes the log-impelling block, and the footing of each of the cleaving means is attached to each corresponding body portion thereof at the intersection of two faces of the pyramidal shape.

14. A double-action log splitter as recited in claim 9, wherein the tapered, knife-like edge of the footing of each of the cleaving means is at an acute angle to the longitudinal axis of the body portion in a direction away from the log-impelling block.

15. A double-action log splitter as recited in claim 1, wherein the support frame is provided at one end thereof with hitching means for attaching the log splitter to a vehicle.

16. A double-action log splitter as recited in claim 1, further comprising coupling means for operably interconnecting the carriage, the log-impelling block, and the two-way activating means and for permitting the selective disassembly thereof.

17. A double-action log splitter as recited in claim 16, wherein said coupling means comprises:

a primary coupling aperture formed in the carriage;

a coupling tongue depending from the log-impelling block for insertion through the primary coupling aperture; and a clevis attached to the two-way activating means for receiving said coupling tongue and being releasably secured thereto on the opposite side of the primary coupling aperture from the log-impelling block.

18. A double-action log splitter comprising:

a support frame;

first and second cleaving means for splitting logs, said cleaving means being mounted at fixed positions in a confronting relationship on the exterior of the support frame;

a log-impelling block movable between the first and second cleaving means;

a carriage enclosed within the support frame upholding the log-impelling block and slideably mounted for reciprocating motion substantially within the support frame;

two-way activating means mounted within the support frame at one end of the carriage for driving the carriage and log-impelling block alternately toward the first and the second cleaving means; and coupling means for operably interconnecting the carriage, the log-impelling block, and the two-way activating means, said coupling means permitting the easy disassembly of the carriage, the log-impelling block, and the two-way activating means, said coupling means comprising:

a primary coupling aperture formed in the carriage;

a coupling tongue depending from the log-impelling block for insertion through the primary coupling aperture;

a clevis attached to the two-way activating means for receiving said coupling tongue and being releasably secured thereto on the opposite side of the primary coupling aperture from the log-impelling block; and means provided on said carriage for receiving the tip of the coupling tongue on the opposite side of the clevis from the primary coupling aperture when the clevis is releasably secured to the coupling tongue.

19. A double-action log splitter as recited in claim 18, wherein the means for receiving the tip of the coupling tongue comprises a supplemental coupling aperture formed in the carriage laterally opposite the primary coupling aperture.

20. A double-action log splitter as recited in claim 18, wherein the coupling tongue defines a plane and said plane is aligned with the line of motion of the log-impelling block between the first and second cleaving means.

21. A double-action log splitter as recited in claim 19, wherein the cross-section of the primary and supplemental coupling apertures conform substantially to the cross-section of the portions of the coupling tongue correspondingly received therein when the coupling tongue is releasably secured to the clevis, thereby precluding translation or rotation of the log-impelling block in relation to the carriage during operation of the log splitter.

22. A double-action log splitter as recited in claim 18, wherein access is afforded through the carriage and the support frame to facilitate interconnection and selective disassembly of the clevis, the carriage, and the coupling tongue.

23. A hydraulic log splitter comprising:

a support frame housing an elongated enclosure;

cleaving means for splitting logs mounted on the exterior of the support frame;

a carriage slideably mounted within the elongated enclosure for reciprocating motion substantially within the elongated enclosure;

a log-impelling block on the exterior of the support frame releasably secured to the carriage and movable therewith between a loading position remote from the cleaving means, wherein a log for processing is receivable between the log-impelling block and the cleaving means, and a cleaving position before the cleaving means;

hydraulic cylinder means mounted within the enclosure at one end of the carriage for propelling the carriage and driving the log-impelling block from the loading position to the cleaving position, whereby a log between the log-impelling block and the cleaving means is split by being forced against the cleaving means;

a primary coupling aperture formed in the carriage;

a coupling tongue depending from the log-impelling block for insertion through the primary coupling aperture;

a clevis attached to the two-way activating means for receiving the coupling tongue and being releasably secured thereto on the opposite side of the primary coupling aperture from the log-impelling block; and a supplemental coupling aperture formed in the carriage laterally opposite the primary coupling aperture for receiving the tip of the coupling tongue on the opposite side of the clevis from the primary coupling aperture when the clevis is releasably secured to the coupling tongue.

24. A hydraulic log splitter as recited in claim 23, wherein the coupling tongue defines a plane and said plane is aligned with the line of motion of the log-impelling block between the loading and cleaving positions.

25. A hydraulic log splitter as recited in claim 24, wherein the primary and supplemental coupling apertures closely encircle the coupling tongue when the clevis is releasably secured thereto, thereby precluding translation or rotation of the log-impelling block in relation to the carriage during operation of the log splitter.

26. A hydraulic log splitter as recited in claim 23, wherein access is afforded through the carriage and the frame to facilitate interconnection and selective disassembly of the clevis, the carriage, and the coupling tongue.

27. A hydraulic log splitter as recited in claim 23, wherein the cleaving means comprises:

an elongated tapered body portion having a vertex opposing the log-impelling block and a longitudinal axis parallel the line of motion of the log-impelling block; and a generally planar footing having a tapered, knife-like edge opposing the log-impelling block attached to the body portion, said footing defining a plane normal to the exterior of the support frame in the portion thereof between the loading and cleaving positions and containing all points on the longitudinal axis thereof.

28. A hydraulic log splitter as recited in claim 27, wherein the body portion of the cleaving means is a cone, and the apex of said cone opposes the log-impelling block.

29. A hydraulic log splitter as recited in claim 27, wherein the body portion of the cleaving means is of pyramidal shape, the apex of said pyramidal shape opposes the log-impelling block, and the footing of the cleaving means is attached to the body portion thereof at the intersection of two faces of the pyramidal shape.

30. A hydraulic log splitter as recited in claim 27, wherein the tapered, knife-like edge of the footing of the cleaving means is at an acute angle to the longitudinal axis of the body portion in a direction away from the log-impelling block.

31. A hydraulic log splitter as recited in claim 23, wherein the support frame and the carriage are each generally cylindrical shells.

32. A hydraulic log splitter comprising:

a support frame housing an elongated enclosure;

cleaving means for splitting logs mounted on the exterior of the support frame;

a carriage slideably mounted within the elongated enclosure for reciprocating motion substantially within the elongated enclosure;

a log-impelling block on the exterior of the support frame releasably secured to the carriage and movable therewith between a loading position remote from the cleaving means, wherein a log for processing is receivable between the log-impelling block and the cleaving means, and a cleaving position before the cleaving means;

hydraulic cylinder means mounted within the enclosure at one end of the carriage for propelling the carriage and driving the log-impelling block from the loading position to the cleaving position, whereby a log between the log-impelling block and the cleaving means is split by being forced against and onto the cleaving means; and at least two bearing surfaces on the exterior of the carriage that ride against the inner surface of the support frame during the motion of the carriage therewithin, said bearing surfaces being spatially separated in a direction parallel the motion of the carriage.

33. A hydraulic log splitter as recited in claim 32, wherein each bearing surface substantially encircles the carriage.

34. A hydraulic log splitter as recited in claim 33, wherein each bearing surface substantially conforms to the cross-section of the elongated enclosure.

35. A hydraulic log splitter as recited in claim 32, wherein the distance between the bearing surfaces is greater than or equal to the lateral dimension of the elongated enclosure.

36. A hydraulic log splitter as recited in claim 35, wherein the distance between the bearing surfaces is greater than or equal to twice the lateral dimension of the elongated enclosure.

37. A hydraulic log splitter as recited in claim 36, wherein the distance between the bearing surfaces is greater than or equal to three times the lateral dimension of the elongated enclosure.

38. A hydraulic log splitter as recited in claim 35, wherein the bearing surfaces are cylindrical.

39. A hydraulic log splitter as recited in claim 36, wherein the bearing surfaces are cylindrical.

40. A hydraulic log splitter as recited in claim 37, wherein the bearing surfaces are cylindrical.

41. A hydraulic log splitter as recited in claim 23, wherein the support frame between the loading and the cleaving positions of the log-impelling block is formed into an elongated slot through which the coupling tongue of the log-impelling block is releasably secured to the carriage.

42. A hydraulic log splitter as recited in claim 41, wherein a log support flange is attached to the exterior of the support frame on either side of the elongated slot.

43. A double-action hydraulic log splitter, comprising:

a hollow, cylindrical support frame having formed therein an elongated slot parallel the axis of the support frame;

first and second cleaving blades mounted at fixed positions in a confronting relationship on the exterior of the support frame at opposite ends of the elongated slot, the first and second cleaving blades each comprising:

an elongated conical body portion having a vertex directed toward the other of the cleaving blades and a longitudinal axis parallel the axis of the support frame; and a generally planar footing having a tapered, knife-like edge oriented toward the other of the cleaving blades, said footing being attached to the body portion and defining a plane containing all points on longitudinal axis thereof;

a hollow, cylindrical carriage slideably mounted within the support frame for reciprocating motion substantially therewithin, said carriage being provided on opposite sides thereof with means defining a primary and a supplementary coupling slot;

a log-impelling block on the exterior of the support frame having a depending coupling tongue for insertion through the elongated enclosure in the support frame and through the primary and supplementary coupling apertures in the carriage, said log-impelling block releasably secured to the carriage and movable therewith between the first and second cleaving blades; and two-way hydraulic cylinder means mounted within the support frame at one end of the carriage and having a clevis releasably secured to the coupling tongue between the primary and supplementary apertures in the carriage for propelling the carriage and driving the log-impelling block between the first and second cleaving blades, whereby a log placed against the support frame between the log-impelling block and either of the cleaving means is split by being forced onto that cleaving means.

* * * * *

UNITED STATES PATENT AND TRADEMARK OFFICE

CERTIFICATE OF CORRECTION

PATENT NO. : 4,679,607

DATED : July 14, 1987

INVENTOR(S) : Terry Bradley

It is certified that error appears in the above-identified patent and that said Letters Patent are hereby corrected as shown below:

Abstract, line 8, "preferable" should be --preferably--
Column 1, line 60, "fortunitiously" should be --fortuitously--
Column 2, line 40, "a elongated" should be --an elongated--
Column 4, lines 58-59, "easily disassemble" should be --easily disassembled--
Column 5, lines 4-5, "the accompany drawings" should be --the accompanying drawings--
Column 6, line 26, "balde 24." should be --blade 24.--
Column 6, line 49, "which is cross-section" should be --which is a cross-section--
Column 7, line 39, "log-impelling block" should be --a log-impelling block--
Column 8, line 39, "eight-inches" should be --eight inches--

Signed and Sealed this

Tenth Day of November, 1987

*Attest:*

*Attesting Officer*

DONALD J. QUIGG

*Commissioner of Patents and Trademarks*